United States Patent [19]

Stehr et al.

[11] Patent Number: 4,596,131

[45] Date of Patent: Jun. 24, 1986

[54] ASSEMBLY FOR GUIDING THE MOVEMENT OF A STAMPER IN A FORMING MACHINE

[75] Inventors: Franz Stehr, Bergisch-Gladbach; Fed. Rep. of Germany

[73] Assignee: Eumuco Aktiengesellschaft für Maschinenbau, Leverkusen, Fed. Rep. of Germany

[21] Appl. No.: 632,833

[22] Filed: Jul. 20, 1984

[30] Foreign Application Priority Data

Aug. 9, 1983 [DE] Fed. Rep. of Germany ..... 3328631

[51] Int. Cl.[4] ..... B21D 37/10

[52] U.S. Cl. ..... 72/456; 72/448; 403/353; 384/26

[58] Field of Search ..... 72/456, 462, 448; 100/282; 308/3 R, 3 A; 403/353

[56] References Cited

U.S. PATENT DOCUMENTS

| | | | |
|---|---|---|---|
| 2,914,362 | 11/1954 | Ott et al. | 308/3 A |
| 3,389,653 | 6/1968 | Hany | 308/3 R |
| 3,448,657 | 6/1969 | Huser et al. | 308/3 R |
| 3,465,669 | 9/1969 | Doudet | 308/3 R |
| 3,465,829 | 9/1969 | Fisher et al. | 308/3 R |
| 3,469,058 | 9/1969 | O'Connor | 308/3 R |

FOREIGN PATENT DOCUMENTS

| | | | |
|---|---|---|---|
| 1037505 | 6/1966 | United Kingdom | 72/456 |

*Primary Examiner*—Francis S. Husar
*Assistant Examiner*—David B. Jones
*Attorney, Agent, or Firm*—Neil F. Markva

[57] ABSTRACT

The assembly is used to guide a movably mounted stamper member in a hot forming machine wherein the guide surfaces located between the stamper member and the machine frame are disposed in an X-arrangement with respect to each other. The inclined angle of each of the guide surfaces is directed approximately to a common central point. Adjustable ledges or strips are fitted to the guide surfaces for setting the clearance between the stamper member and the machine frame. Stamper side carrier rails and support side carrier rails carry the guide surfaces and are directly formed as a part of the stamper member and the frame or frame stanchions. The adjusting strips used for setting the clearance and the securing means for these strips, run approximately parallel to the guide surface. Thus, the stamper member is directly supported on the surfaces of the machine frame. The particular configuration of the carrier rails enable relative horizontal movement between the stamper element and the machine frame so that insertion of the stamper element into the forming machine is facilitated.

9 Claims, 3 Drawing Figures

ASSEMBLY FOR GUIDING THE MOVEMENT OF A STAMPER IN A FORMING MACHINE

FIELD OF INVENTION

This invention relates to an assembly for guiding the movement of a stamper member in forming machines. More particularly, the assembly is used to guide the stamper of a hot forming machine such as in a drop forging press. Such an arrangement includes guide surfaces located between the stamper member and the machine frame.

BACKGROUND OF THE INVENTION

The guides surfaces located between the stamper member and the machine frame are generally in an X-arrangement with respect to each other and have an angle inclined in a direction approximately directed to a common central point. Adjustable strips are fitted to the guide surfaces for adjusting the clearance between the stamper member and the machine frame.

Forming machines such as drop forging presses used for hot forming have slide guiding surfaces in a so-called X-arrangement. When the stamper member gets hot while being used during the hot forming process, the material of the stamper member expands. As is known, the stamper member grows in the right-angled guides or box guides. In other words, the expansion takes place into the guide clearance generally available between the stamper member and the forming machine frame and thus leads to constant clearance changes.

This problem adversely affects the accuracy of the work process and leads to disturbances in the forming machines because of heating and wear.

In the X-arrangement of the guide surfaces to one another, there is, with expansion as a consequence of heating, a resultant in the direction parallel to the guide surface. The guide clearance set is not changed by this, and the difficulties mentioned above with box guides or similar guides are removed.

Generally, in the known guide assemblies, a carrier rail is disposed along the entire stamper member height to support a guide strip therealong. The carrier rail is screwed at least on the rear of the stamper member or the front of the stamper member on either the stamper-side or the support-side. These known carrier rails are removably mounted on either the stamper or support frame and as removable components make it possible to insert the stamper member into the forming machine. Thus, the removably mounted carrier rail is used at the same time for clearance adjustment either by means of driving screws, pressure screws, or by shim plates.

Consequently, the removably mounted carrier rails are particularly weak in stability and guide quality because of the flux of force concentration. That is, they cannot guarantee a stable guiding and thus the guide rigidity is considerably adversely affected.

PURPOSE OF THE INVENTION

The primary object of this invention is to provide a guide assembly for a stamper member of the type mentioned which is extremely stable and permanent with respect to the guide rigidity and facilitates the possibility of mounting the stamper in the frame of the forming machine.

Another object of the invention is to provide an assembly for guiding the movement of a stamper member in a forming machine which eliminates the disadvantages associated with existing guide assemblies.

SUMMARY OF THE INVENTION

The invention as disclosed and claimed herein is directed to stamper side carrier rails and support side carrier rails which directly form part of the respective stamper member and support frame members of the forming machine. Adjusting strips are disposed on the carrier members and used for adjusting the clearance and the securing means for the adjusting strips run approximately parallel to the guide surface disposed along the carrier rail.

The stamper side and support side guide parts are rigidly arranged as a part of the stamper member and the support frame member. With such a construction of the guide assembly, the force flux from the guide forces of the stamper member is no longer conveyed over screw connections but the stamper member is supported directly on the surfaces on the machine frames or the framed stanchions. With the adjusting screws running approximagely parallel to the guide surface, they are not loaded because they do not lie in the force flux. That is, with the particular arrangement of the adjusting strips and securing means, the force flux is directly conveyed over the corresponding support surfaces.

In accordance with another feature of the invention, the adjusting strips have a wedge-shaped cross section when disposed in a vertical disposition along the carrier rails. The wedge strips or V-ledges have a slight incline sufficient to produce a self-locking or irreversible effect to the adjusting strips. Through the construction of the adjusting strips and their disposition on the carrier rails, it is safely guaranteed that the securing means are free from the effects of the force flux. Therefore, there is no influence on impairment of the guide rigidity between the stamper member and the machine frame along with the carrier rails are directly formed.

Another feature of the invention provides the carrier rails with an interrupted configuration to form an upper carrier rail section and a lower carrier rail section on the respective stamper member and frame members as seen in the elevational-height direction. The upper carrier rail sections are vertically, laterally spaced with respect to the lower carrier rails sections in each instance to provide enough distance to receive the corresponding carrier rail sections formed directly as a part of the stamper member and machine frame member. This configuration thus provides a bayonet-like relationship to allow the stamper member to move horizontally into and out of the forming machine. This simplifies the insertion of a stamper member into the frame and makes the use of screwed on carrier rails unnecessary.

The bayonet-like division of the interrupted carrier rails sections and lower carrier rails sections produces a quick and simple assembly with secure guiding of the stamper member to the frame structure of the forming machine. The division of the guide strips also has the advantage that with the occurence of different wear, a different adjustment or setting of clearance can occur. The adjusting, wedge-shaped strips are also interrupted to fit along the length of the upper and lower carrier rail sections.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
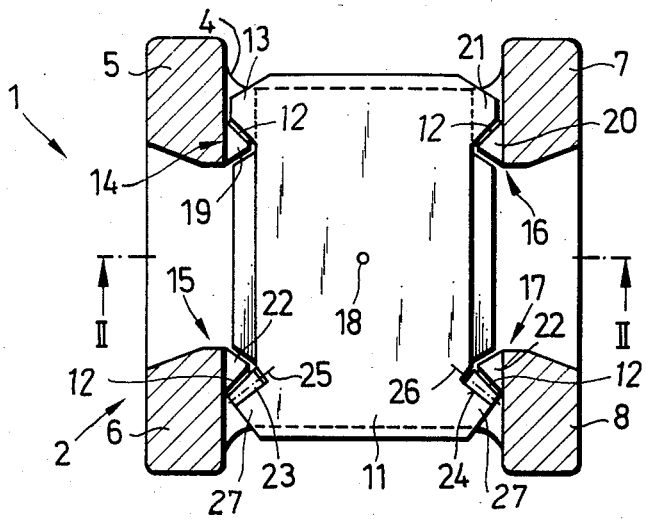
FIG. 1 is a sectional view of a machine frame of a forming machine with the stamper guide in the machine frame according to the invention (See line I—I on FIG. 2)

The forming machine, generally designed 1, for example, a drop forging press, includes a machine frame 2 having an upper cross piece 3 and a lower cross piece 4 and four framed stanchions 5, 6, 7, and 8. Machine frame 1 may be assembled from individual parts or be constructed as a one-piece, unitary structure. The upper portion of machine frame 1 includes openings 9 and 10 which support a crankshaft or eccentric shaft. Stamper member 11 moves upwardly and downwardly as a result of connection to the crankshaft or eccentric shaft which effects movement thereof in a well known manner.

Guide assemblies, generally designed 14, 15, 16, and 17, include carrier rails on the stamper 11, and the framed stanchions 5, 6, 7 and 8, respectively. Stamper-side carrier rails 13, 21, and 27 grip together with support-side carrier rails 19, 20 and 22, respectively, which form the guide assemblies 14, 15, 16 and 17. Stamper-side carrier rails 13, 21 and 27 are rigidly formed and attached to the sides of the stamper 11 and the support-side carrier rails 19, 20, and 22 are rigidly formed and attached to the frame stanchions or supports 5, 6, 7 and 8. Such carrier rails may be formed as a integral part of the stamper 11 or frame supports 5, 6, 7 and 8 at the time of their construction.

Guide assemblies 14, 15, 16 and 17 are disposed in an X-arrangement with respect to each other and include guide surfaces which are inclined at an angle directed to a common central point 18. Stamper 11 is supported on the guide surfaces of the support-side carrier rails 19, 20 and 22. Guide or sliding strips 12 are disposed along the guide surfaces of the stamper-side carrier rails 19, 20 and 22 and comprise bronze or nitride strips.

Adjusting strips 23 and 24 are wedge-shaped and fitted on stamper-side carrier rails 27. Strips 23 and 24 are self-locking, irreversible and adjustable. Securing means such as adjusting screws have a longitudinal axis which extends in a direction which is approximately parallel to the guide surfaces. That is, the screws are disposed along the central axes 25 and 26 of the wedge-shaped adjustment strips 23 and 24. Consequently, adjusting strips 23 and 24 and the respective screws are not loaded when guide forces occur because they do not lie in the force of flux. The adjustable, wedge-shaped strips 23 and 24 are constructed as self-locking or irreversible in their wedge angle. The wedge angle for adjusting strips 23 and 24 is in the range of about 5 to about 8 degrees. This angle refers to the total wedge inclination and is measured from inclined plane to inclined plane. Once the wedge-shaped strips 23 and 24 are in place, they will move out of position. Thus, strips 23 and 24 are known as self-locking or irreversible.

The guide assemblies 14, 15, 16 and 17 are divided or split along their vertical lengths. That is, there are interruptions or breaks along the lengths of the respective stamper-side carrier rails 13, 21 and 27 and support-side carrier rails 19, 20 and 22. Thus, each of the carrier rails has an upper section and a lower section so that along the vertical length there are at least two interrupted carrier rails 13*a*, 13*b*; 19*a*, 19*b*; 20*a*, 20*b*; 21*a*, 21*b*; 22*a*, 22*b*; and 27*a*, 27*b*. This is shown clearly in the FIGS. 2 and 3. This divided configuration as used for the carrier rails on stamper member 11 and stanchions 6 and 8 is matched by the upper and lower sections of the wedge-shaped strips 23 and 24 along the vertical length of stamper member 11.

Figure 2:
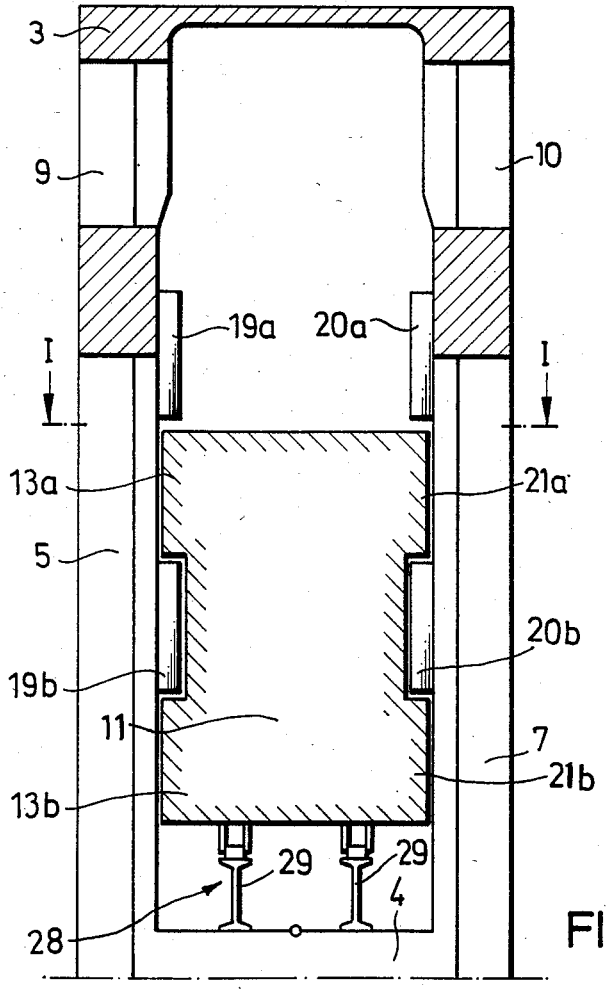
FIG. 2 is a sectional view along line II—II of Figure one with the stamper in the insertion position.

Stamper-side carrier rails 13, 21 and 27 and support-side carrier rails 19, 20 and 22 comprise raised attachments forming parts of the stamper 11 and support stanchions 5, 6, 7 and 8. At the same time, the division of the stamper-side and support-side carrier rails into upper and lower guide sections make it possible for the insertion of stamper 11 between the framed stanchions from the front or from the rear. That is, as shown in FIG. 2, the upper support side carrier rails 19*b* and 20*b* located on stanchions 5 and 7, respectively, have a length which fits between the facing ends of the stamper-side carriers rails 13*a*, 13*b* and 21*a*, 21*b*, respectively. With the wedge-shaped strips 23 and 24 being interrupted with upper and lower sections, it is now possible that different adjustability can be affected in the upper and lower guide regions as necessary.

Figure 3:
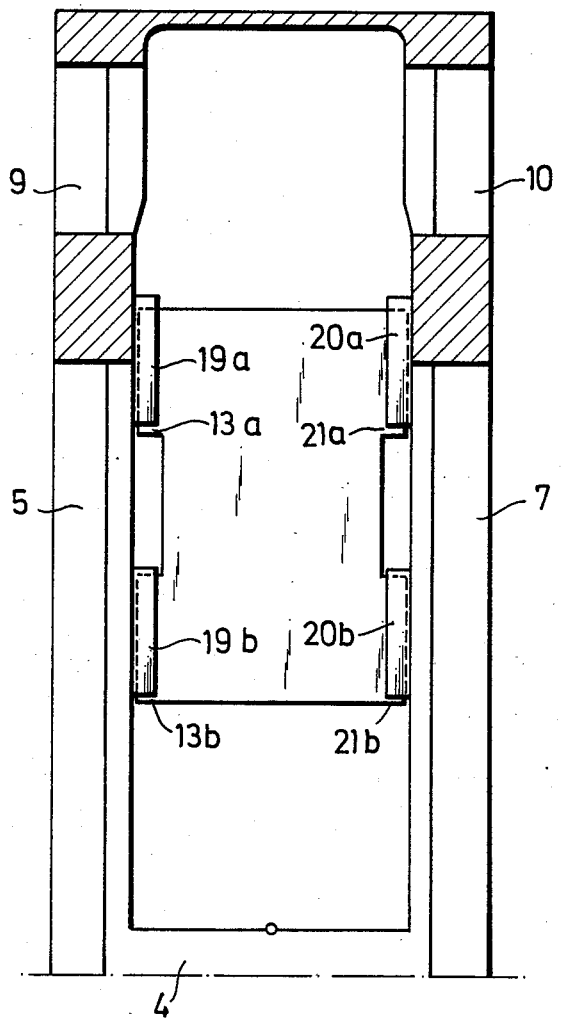
FIG. 3 is a sectional view as shown in Figure two showing the stamper inserted in the machine frame in the lower dead position.

A mounting assembly 28 includes rails 29 disposed on the lower cross-piece 4 to support stamper 11 while being inserted into position within the framework formed by vertical stanchions 5, 6, 7 and 8. As shown in FIG. 2, stamper 11 is in the insertion or assembly position with the lower support-side carrier rails 19*b* and 20*b* fitting in a bayonet-type relationship with respect to stamper-side carrier rails 13*a*, 13*b* and 21*a*, 21*b*, respectively. Once completely inserted into the position so that the respective inclined surfaces of the stamper-side guide rails and support-side guide rails are facing one another, stamper 11 is raised into the position as shown in FIG. 3 which is the lower dead position with respect to the forming machine such as a drop forging press. While in this lower, dead position, stamper 11 is connected to a drive assembly having a crankshaft or the like which extends through upper openings 9 and 10 in a well known manner to effectuate the raising and lowering of stamper 11 during operation of the forming machine or forging press. The innerconnection between stamper 11 and such stamper dirve assembly is well known.

While the assembly for guiding the movement of a stamper in a forming machine has been shown and described in detail, it is obvious that this machine is not to be considered as limited to the exact form disclosed, and that changes in detail and construction may be made therein within the scope of the invention without departing from the spirit thereof.

Having thus set forth and disclosed the nature of the invention, what is claimed is:

1. An assembly as defined in claim 1 wherein the adjusting strips are wedge-shaped strips as seen in horizontal cross section when disposed on the vertically extending carrier rails, said wedge-shaped strips have a slight incline sufficient to produce a self-locking or irreversible effect.

2. An assembly (as defined in claim 1 wherein) for guiding a movably mounted stamper member in a forming machine wherein guide surfaces are located between the stamper member and the machine frame and as seen in cross section are disposed in an X-arrangement with respect to one another with their inclined angle directed approximately to a common, central point, said assembly comprising:

(a) stamper-side carrier rails and support-side carrier rails including said guide surfaces, (b) said stamper-side carrier rails directly form part of the stamper member and said support side carrier rails directly form part of the machine frame, (c) means for adjusting clearance between the stamper member and the machine frame, (d) said clearance adjusting means including adjusting strips and means for securing the adjusting strips to carrier rails, (e) said securing means have a longitudinal axis which extends approximately parallel with respect to the guide surface of the respective carrier rail, (f) said stamper-side carrier rails and said supporting side carrier rails each include an upper carrier rail section and a lower carrier rail section vertically spaced with respect to each other, (g) the vertical spacing between the upper and lower carrier rail sections on the stamper member and support frame members of the machine being effective to receive the carrier rail section of the opposed stamper member or support member such that they may be passed by one another in a bayonet-type closure combination to provide an interlocking relationship between the stamper member and the machine frame.

3. An assembly as defined in claim 2 wherein the adjusting strips are wedge-shaped strips as seen in horizontal cross section when disposed on the vertically extending carrier rails, said wedge-shaped strips have a slight incline sufficient to produce a self-locking or irreversible effect.

4. An assembly as defined in claim 2 wherein the adjusting strips are (interruped) interrupted to form an upper wedge-shaped strip section and a lower wedge-shaped strip section to correspond to the upper and lower carrier rail sections of the stamper member and the machine frame.

5. An assembly for guiding a movably mounted stamper member in a forming machine wherein guide surfaces are located between the stamper member and the machine frame and as seen in cross section are disposed in an X-arrangement with respect to one another with their inclined angle directed approximately to a common, central point, said assembly comprising:

(a) stamper-side carrier rails and support-side carrier rails including said guide surfaces, (b) said stamper-side carrier rails directly form part of the stamper member and said support side carrier rails directly form part of the machine frame, (c) said stamper-side carrier rails and said support-side carrier rails each include an upper carrier rail section and a lower carrier rail section vertically spaced with respect to each other, (d) the vertical spacing between the upper and lower carrier rail sections on the stamper member and support frame members of the machine being effective to receive the carrier rail section of the opposed stamper member or support member such that they may be passed by one another in a bayonet-type closure combination to provide an interlocking relationship between the stamper member and the machine frame.

6. An assembly as defined in claim 5 further including means for adjusting clearance between the stamper member and the machine frame.

7. An assembly as defined in claim 6 wherein said clearance adjusting means including adjusting strips and means for securing the adjusting strips to carrier rails.

8. An assembly as defined in claim 7 wherein the adjusting strips are wedge-shaped strips as seen in horizontal cross section when disposed on the vertically extending carrier rails, said wedge-shaped strips have a slight incline sufficient to produce a self-locking or irreversible effect.

9. An assembly as defined in claim 7 wherein the adjusting strips are interrupted to form an upper wedge-shaped strip section and a lower wedge-shaped strip section to correspond to the upper and lower carrier rail sections of the stamper member and the machine frame.

* * * * *